United States Patent [19]

Lalvani et al.

[11] Patent Number: 4,940,653

[45] Date of Patent: Jul. 10, 1990

[54] MULTILAYERED COLOR PHOTOGRAPHIC MATERIAL HAVING AN ALKALI SOLUBLE INTERLAYER

[75] Inventors: Prem Lalvani; Diethart Lademann, both of Leverkusen; Hans Buschmann, Cologne; Heinz Reif, Cologne; Walther Cohnen, Cologne, all of Fed. Rep. of Germany

[73] Assignee: Agfa-Gevaert Aktiengesellschaft, Leverkusen, Fed. Rep. of Germany

[21] Appl. No.: 410,950

[22] Filed: Sep. 22, 1989

Related U.S. Application Data

[63] Continuation of Ser. No. 95,905, Sep. 14, 1987, abandoned.

[51] Int. Cl.[5] ..... G03C 1/46

[52] U.S. Cl. ..... 430/502; 430/505; 430/523; 430/950; 430/961

[58] Field of Search ..... 430/523, 500, 950, 861, 430/502, 505

[56] References Cited

U.S. PATENT DOCUMENTS

| | | | |
|---|---|---|---|
| 2,992,101 | 7/1961 | Jelley et al. | 430/523 |
| 4,232,117 | 11/1980 | Naoi et al. | 430/523 |
| 4,367,284 | 1/1983 | Cellone et al. | 430/539 |
| 4,399,213 | 8/1983 | Watanabe et al. | 430/523 |
| 4,447,525 | 5/1984 | Vallarino et al. | 430/539 |
| 4,499,179 | 2/1985 | Ota et al. | 430/523 |
| 4,524,131 | 6/1985 | Himmelmann et al. | 430/523 |
| 4,603,102 | 7/1986 | Himmelmann et al. | 430/523 |
| 4,822,727 | 4/1989 | Ishigaki et al. | 430/523 |

*Primary Examiner*—Jack P. Brammer

[57] ABSTRACT

In a process for the preparation of a multilayered photographic material in which the layers are applied in at least two stages and the material is dried and wound up in between the stages, sticking of the semi-finished preparations does not occur if the uppermost layer applied in the first stage contains polymer particles soluble in alkali and having an average particle diameter from 0.2 to 5.0 μm.

5 Claims, No Drawings

MULTILAYERED COLOR PHOTOGRAPHIC MATERIAL HAVING AN ALKALI SOLUBLE INTERLAYER

CROSS REFERENCE TO RELATED APPLICATION

This case is a continuation of our copending application, U.S. Ser. No. 095,905 filed Sept. 14, 1987, now abandoned.

This invention relates to the preparation of a multilayered photographic material having an interlayer containing certain polymer particles.

It is known that the layers of a multilayered photographic recording material in many cases cannot all be applied to the support in a single operation but must be applied in at least two stages. Each stage may entail the application of single layers or the application of layer packets composed of several layers. The uppermost layer of a packet applied in a single stage normally contains a hydrophilic binder such as gelatine, a wetting agent and optionally an alkali, a softener, dyes and colloidal silver.

The photographic materials are dried and wound up after each stage before the next layer or packet of layers is applied. If the semi-finished products are rolled up, the surfaces tend to stick together so that patches are formed on the material.

It is known that in a completely finished film this undesirable effect may be prevented by introducing so-called spacers or matting agents into the uppermost layer, i.e. solid particles having an average particle diameter of at least 1 μm. This method is not applicable to layers which form the upper layers in one stage but are subsequently covered by other layers as it leads to fogging, uneven casting and loss of breaking strength.

Further, it has been suggested to introduce matting agents into interlayers of acid-treated gelatine which are the uppermost layers during production. As matting agents organic or inorganic materials, insoluble in water with an average particle diameter of from 0.2 to 5 μm can be used. The difference between the refractive index of these particles and the refractive index of gelatine causes increased light-scattering at these particles which leads to enhanced graininess (DE-A-2 526 970).

It is therefore an object of the present invention to develop interlayers which prevent sticking of the uppermost layer applied in the first stage of a coating process entailing the application of all the layers in two or more stages and which also reduce static friction. These interlayers should not have any deleterious effect on other photographic properties of the material, in particular the sensitometric properties.

A process for the preparation of a multilayered photographic material has now been found in which the layers are applied in at least two stages and the material is dried and wound up in between the stages but in which the disadvantages indicated above are avoided, characterised in that the uppermost layer of the layers applied in the first stage contains polymer particles soluble in alkali and having an average particle diameter from 0.2 to 5.0 μm.

The particle diameter is preferably from 0.5 to 3.0 μm. Suitable polymeric particles soluble in alkali belong to the following chemical groups:

1. Copolymers of alkyl methacrylates with methacrylic acid, acrylic acid or itaconic acid.

2. Copolymers of alkyl methacrylates with semi-esters and semi-amides of maleic acid.
3. Copolymers of styrene with α, β-unsaturated mono- or dicarboxylic acids, or semi-esters or semi-amides of dicarboxylic acids.
4. Graft polymers of methacrylic acid/methyl methacrylate on water soluble dispersing agents of maleic acid anhydride/α-olefin.
5. Cellulose derivatives of semi-esters of dicarboxylic esters, e.g. phthalates and hexahydrophthalates of methyl cellulose, hydroxyethyl methyl cellulose or hydroxypropyl methyl cellulose.

The amounts of monomers are chosen in that way that the particles are insoluble in water at a pH below 5 and soluble in water at a pH above 7.

The layer which contains the polymer particles soluble in alkali may also contain the usual additives such as hydrophilic binders, e.g. gelatine, especially alkali treated gelatine, wetting agents, particularly surface-active organic fluoro compounds, formalin acceptors, softeners, colloidal silver and dyes.

The polymer particles are normally applied in a quantity of 20 to 200 mg/m$^2$ of photographic material, in particular 50 to 120 mg/m$^2$ of photographic material. They are added to the casting solution as an aqueous dispersion.

It is surprisingly found that the addition of the above-mentioned particles prevents the formation of patches due to sticking, reduces the static coefficient of friction and reduces exposure due to static discharges without affecting the photographic properties of the multilayered photographic material, in particular its graininess and sharpness.

The process according to the invention may be used for the preparation of any multilayered photographic material in which the layers are applied in at least two stages, for example for the preparation of negative and reversal films and photographic paper, but especially for colour negative films and colour reversal films. If the layers are applied in more than two stages then the procedure according to the invention may be repeated as required.

The photographic materials prepared according to the invention may be exposed in the usual manner and processed by the usual methods.

The matting agents according to the invention are dissolved from the photographic material by the alkaline developer. Thereby light-scattering at the particles because of different refractive indices is avoided. Surprisingly, no pores remain in the material, which themselves could cause negative effects.

The photographic materials, in particular colour photographic recording materials for which the process according to the invention may advantageously be employed are preferably multilayered materials containing several silver halide emulsion layers or emulsion layer units differing in their spectral sensitivity. The emulsion layer units may be laminates of two or more silver halide emulsion layers all having the same spectral sensitivity although layers having the same spectral sensitivity need not necessarily be arranged adjacent to one another but may be separated by other layers, in particular by layers having a different spectral sensitivity. The binder in these layers is generally a proteinaceous binder containing free carboxyl groups and free amino groups, preferably gelatine. In addition to the proteinaceous binder the layer or binder may contain up to 50% by weight of a non-proteinaceous binder such as polyvinyl alcohol, N-vinylpyrrolidone or polyacrylic acid and derivatives thereof, in particular copolymers or cellulose derivatives.

The light-sensitive silver halide emulsion layers or emulsion layer units have at least one colour producing compound associated with them, generally a colour coupler, which is capable of reacting with colour developer oxidation products to form a non-diffusible dye. The colour couplers are advantageously non-diffusible and accommodated either in the light-sensitive layer itself or in close vicinity thereto. The colour couplers associated with two or more partial layers of an emulsion layer unit need not be identical, provided they give rise to the same colour on colour development, normally a colour which is complementary to the colour of the light to which the light-sensitive silver halide emulsion layers are sensitive.

The red-sensitive silver halide emulsion layers therefore have at least one non-diffusible colour coupler associated with them to produce the cyan partial colour image, generally a coupler of the phenol or α-naphthol series. The cyan couplers described in U.S. Pat. Nos. 2,474,293, 2,367,531, 2,895,826, 3,772,002, EP-A-0 028 099 and EP-A-0 112 514 are examples which should be particularly mentioned.

The green-sensitive silver halide emulsion layers contain at least one non-diffusible colour coupler for producing the magenta partial colour image, normally a colour coupler of the 5-pyrazolone or the indazolone series. Cyanoacetyl compounds, oxazolones and pyrazoloazoles may also be used as magenta couplers. Particularly suitable magenta couplers include, for example, those described in U.S. Pat. Nos. 2,600,788, 4,383,027, DE-A-1 547 803, DE-A-1 810 464, DE-A-2 408 665 and DE-A-3 226 163.

The blue-sensitive silver halide emulsion layers contain at least one non-diffusible colour coupler for producing the yellow partial colour image, generally a colour coupler having an open chain ketomethylene group. Particularly important in this connection are, for example, yellow couplers of the kind described in U.S. Pat. Nos. 3,408,194, 3,933,501, DE-A-2 329 587 and DE-A-2 456 976.

Many colour couplers of these kinds are known and have been described in numerous Patent Specifications. References may also be found, for example, in the publication entitled "Farbkuppler" by W. Pelz in "Mitteilungen aus den Forschungslaboratorien der AGFA, Leverkusen/München, Volume III (1961) page 111 and the publication by K. Venkataraman in "The Chemistry of Synthetic Dyes", Vol. 4, 341 to 387, Academic Press (1971).

The colour couplers may be 4-equivalent couplers or 2-equivalent couplers. The latter are derived, as is known, from 4-equivalent couplers in that they carry in the coupling position a substituent which is split off in the coupling reaction. Some 2-equivalent couplers are virtually colourless while others have an intense colour of their own which disappears in the process of colour coupling and may be replaced by the colour of the image dye produced (masking couplers). The known white couplers should in principle also be regarded as 2-equivalent couplers although they give rise to virtually colourless products in their reaction with colour developer oxidation products. In some 2-equivalent couplers, the group which is released from the coupling position in the reaction with colour developer oxidation products is one which develops some particular desirable photographic activity when released, e.g. it may act as development inhibitor or accelerator, either directly or after it has itself split off one or more further groups (e.g. DE-A-2 703 145, DE-A-2 855 697, DE-A-3 105 026 and DE-A-3 319 428). Examples of such 2-equivalent couplers include the known DIR couplers as well as DAR and FAR couplers.

Suitable DIR couplers have been described, for example, in GB-A-953 454, DE-A-1 800 420, DE-A-2 015 867, DE-A-2 414 006, DE-A-2 842 063 and DE-A-3 427 235.

Suitable DAR and FAR couplers have been described, for example, in DE-A-3 209 110, EP-A-0 089 834, EP-A-0 117 511 and EP-A-0 118 087.

Since the main purpose of DIR, DAR and FAR couplers is to provide the activity of the group released in the coupling reaction and the colour producing properties of these couplers is less important, it is also suitable to use DIR, DAR and FAR couplers which give rise to substantially colourless products in the coupling reaction, as described, for example, in DE-A-1 547 640.

The releasable group may also be a ballast group so that the reaction with colour developer oxidation products gives rise to coupling products, e.g. dyes, which are diffusible or at least have a slight or limited mobility, for example as described in U.S. Pat. No. 4,420,556.

High molecular weight colour couplers have been described, for example, in DE-C-1 297 417, DE-A-2 407 569, DE-A-3 148 125, DE-A-3 217 200, DE-A-3 320 079, DE-A-3 324 932, DE-A-3 331 743, DE-A-3 340 376, EP-A-27 284 and U.S. Pat. No. 4,080,211. The high molecular weight colour couplers are generally prepared by the polymerisation of ethylenically unsaturated monomeric colour couplers but they may also be obtained by polyaddition or polycondensation.

The layers may contain other additives in addition to the components mentioned above, e.g. hardeners, antioxidants, dye stabilizers and agents for influencing the mechanical and electrostatic properties. The layers may also contain compounds absorbing UV light in order to minimize or prevent the adverse effect of UV light on colour images produced with the colour photographic recording materials according to the invention.

The hardeners used are preferably compounds which activate carboxyl groups, in particular compounds corresponding to the general formula

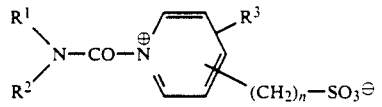

wherein $R^1$ and $R^2$ denote an alkyl group with 1 to 8 carbon atoms or an aryl or aralkyl group optionally substituted with an alkyl group having 1 or 2 carbon atoms or with a halogen atom, or they may together form the atoms required for completing a heterocyclic ring which is optionally substituted with an alkyl group having 1 or 2 carbon atoms or with a halogen atom, $R^3$ denotes a hydrogen atom or an alkyl group having 1 or 2 carbon atoms and n denotes 0 or 2.

A colour photographic recording material for reversal colour development was prepared by applying the layers indicated below to a transparent layer support of cellulose triacetate in the given sequence. Layers 1 and 2, layers 3 to 6, layers 7 to 10 and layers 11 to 14 were applied together and layer 15 was subsequently applied. The quantities given are based on 1 $m^2$. The quantity of silver halide used is given in terms of the corresponding quantities of $AgNO_3$. All silver halide emulsions were stabilized with 0.5 g of 4-hydroxy-6-methyl-1,3,3a,7-tetraazaindene per 100 g of $AgNO_3$.

| | |
|---|---|
| Layer 1 | (antihalation layer)<br>Black colloidal silver salt containing<br>0.5 g of Ag and<br>1.5 g of gelatine |
| Layer 2 | (interlayer)<br>0.9 g of gelatine,<br>0.33 g of $AgNO_3$ (micrat) and<br>0.33 g of octyl hydroquinone |
| Layer 3 | (first red-sensitized layer)<br>red-sensitized silver iodobromide emulsion<br>(5.5 mol-% iodide; average grain diameter<br>0.25 μm) prepared from<br>0.98 g of $AgNO_3$ with<br>0.81 g of gelatine and<br>0.25 g of coupler C - 1 |
| Layer 4 | (2nd red-sensitized layer)<br>red-sensitized silver iodobromide emulsion<br>(6.5 mol-% iodide; average grain diameter 0.6 μm)<br>prepared from<br>0.85 g of $AgNO_3$ with<br>0.7 g of gelatine and<br>0.58 g of coupler C - 1 |
| Layer 5 | Interlayer<br>1 g of gelatine<br>0.2 g of octyl hydroquinone and<br>0.4 g of compound WM - 1 |
| Material 1 | (according to the invention) |
| Layer 6 | Interlayer<br>0.4 g of gelatine<br>0.1 g of hydroxypropyl methyl-cellulose hexahydrophthalate (soluble in alkali) having an average particle diameter of 2.0 μm |
| Material 2 | (not according to the invention) |
| Layer 6 | Interlayer<br>0.4 g of gelatine |
| Material 3 | (not according to the invention) |
| Layer 6 | Interlayer<br>0.4 g of gelatine<br>0.1 g of polymethyl methacrylate having an average particle diameter of 2.0 μm (insoluble in alkali) |

The partial layer arrangements described above (layers 1 to 6) were tested for their sliding properties and surface resistance. The coefficient of friction coefficient of friction = tensile force/normal force × 100) is a measure of the static friction when the material placed face downwards begins to slide over the back and over the front of the same material and over a surface of plush under the action of a traction.

Surface resistance measured at 50% and 20% relative humidity RH

Electrode distance 1 cm

Electrode length 10 cm.

The layers indicated below were applied to the above described partial layer arrangements to build up the material.

| | |
|---|---|
| Layer 7 | (1st green-sensitized layer)<br>green-sensitized silver iodobromide emulsion<br>(4.8 mol % iodide<br>average grain diameter 0.28 μm)<br>prepared from<br>0.94 g of $AgNO_3$ with<br>0.77 g of gelatine and<br>0.30 g of coupler M-1 |

-continued

| | |
|---|---|
| Layer 8 | (2nd green-sensitized layer)<br>green-sensitized silver iodobromide emulsion<br>(4.3 mol % iodide;<br>average grain diameter 0.65 μm)<br>prepared from<br>0.94 g of $AgNO_3$ with<br>0.87 g of gelatine and<br>0.64 g of coupler M-1 |
| Layer 9 | (Interlayer)<br>0.6 g of gelatine<br>0.15 g of ethylene diurea<br>0.08 g of compound WM-1 |
| Layer 10 | (yellow filter layer)<br>yellow colloidal silver sol containing<br>0.2 g of Ag,<br>0.5 g of gelatine and<br>0.12 g of compound WM-1 |
| Layer 11 | (first blue-sensitive layer)<br>silver iodobromide emulsion<br>(4.9 mol % iodide;<br>average grain diameter 0.35 μm)<br>prepared from<br>0.76 g of $AgNO_3$ with<br>0.56 g of gelatine,<br>0.47 g of coupler Y-1 and<br>0.4 g of compound WM-1 |
| Layer 12 | (2nd blue-sensitive layer)<br>silver iodobromide emulsion<br>(3.3 mol % iodide;<br>average grain diameter 0.78 μm)<br>prepared from<br>1.3 g of $AgNO_3$ with<br>0.76 g of gelatine,<br>1.42 g of coupler Y-1 and<br>0.3 g of compound WM-1 |
| Layer 13 | (UV absorbent layer)<br>1.5 g of gelatine<br>0.8 g of compound UV-1 |
| Layer 14 | (intermediate layer)<br>0.9 g of gelatine<br>0.4 g of ethylenediurea |
| Layer 15 | (hardening protective layer)<br>0.3 g of gelatine<br>0.15 g of compound HM-1<br>0.1 g of hydroxypropyl methyl cellulose hexahydrophthalate<br>0.03 g of compound VI-1<br>0.018 g of dimethylpolysiloxane and<br>0.7 g of hardener corresponding to the formula |

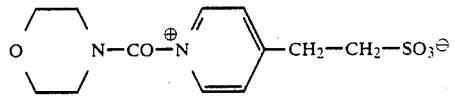

The breaking strength, graininess and sharpness of the completed set of layers were measured. The patches were also assessed visually and marked in percentages.

The parallel breaking strength was defined by the parameters of breaking diameter [mm] and breaking force [N]. A 35 mm strip of the material perforated along a transverse line was formed into a loop and the two sides of the loop were pressed together between two parallel jaws continuously approaching one another. The breaking diameter is the internal diameter of the loop while the breaking force is the force with which the two jaws act on the loop at the moment when the loop breaks along the perforation line. Method described in Research Disclosure 25 302, 5/85. Graininess: RMS granularity described in SPSE Handbook of Photographic Science and Engineering 1973, page 935, measuring aperture 48 μm. Sharpness: MTF described in SPSE Handbook of Photographic Science and Engineering 1973, page 946.

The following compounds were used:

C-1

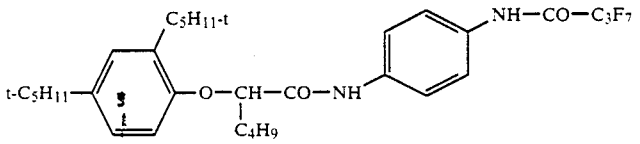

M-1 Coupler 7 from US-A-2 000 788
Y-1 Coupler 16 from US-A-3 933 501
WM-1 Commercial aqueous dispersion of an anionically modified polyurethane

UV-1

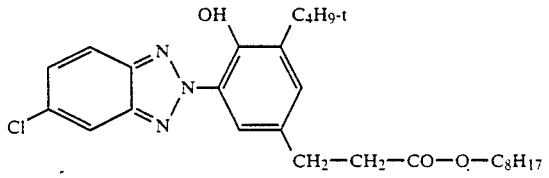

VI-1

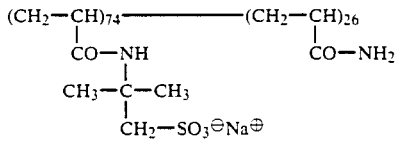

HM-1

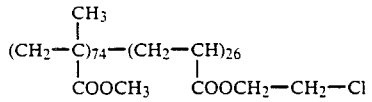

A colour photographic recording material for colour negative development was prepared by applying the layers described below in the given sequence to a transparent layer support of cellulose triacetate. Layers 1 and 2, layers 3 to 5, layers 6 to 9 and layers 10 to 13 were applied together and finally layer 14 was applied. The quantities given are based on 1 $m^2$. The quantities of silver halide applied are given in terms of corresponding quantities of $AgNO_3$. All silver halide emulsions were stabilized with 0.5 g of 4-hydroxy-6-methyl-1,3,3a, 7-tetraazaindene per 100 g of $AgNO_3$.

| | |
|---|---|
| Layer 1 | (Antihalation layer)<br>Black colloidal silver sol containing<br>0.5 g of Ag,<br>0.2 g of octyl hydroquinone and<br>1.5 g of gelatine |
| Layer 2 | (Interlayer)<br>1.0 g of gelatine,<br>0.05 g of octyl hydroquinone |
| Layer 3 | (1st red-sensitized layer)<br>red-sensitized silver iodobromide emulsion prepared from<br>3.5 g of $AgNO_3$ (mixture of 80% by weight of an emulsion containing 5 mol-% of iodide and having an average particle diameter of 0.2 μm and<br>20% by weight of an emulsion containing 7 mol-% of iodide and having an average particle diameter of 0.8 μm),<br>1.7 g of gelatine and<br>0.7 g of coupler mixture C2 emulsified with 0.7 g of tricresyl phosphate |
| Layer 4 | (2nd red-sensitized layer)<br>red-sensitized silver iodobromide emulsion prepared from 2.0 g of $AgNO_3$ (mixture of 20% by weight of an emulsion containing 0.7 mol-% of iodide and having an average particle diameter of 0.8 μm with a close grain sized distribution, and 80% by weight of an emulsion containing 10 mol-% of iodide and having an average particle diameter of 0.8 μm with a broad grain size distribution),<br>2.0 g of gelatine and<br>0.2 g of coupler mixture C2 emulsified with 0.2 g of tricresyl phosphate |
| Layer 5 | (Interlayer)<br>0.7 g of gelatine and<br>0.09 g of 2,5-diisooctylhydroquinone |
| Layer 6 | (1st green-sensitized layer)<br>green-sensitized silver iodobromide emulsion prepared from 2.2 g of $AgNO_3$ (mixture of 65% by weight of an emulsion containing 5 mol-% of iodide and having an average particle diameter of 0.2 μm and 35% by weight of an emulsion containing 7 mol-% of iodide and having an average particle diameter of 0.8 μm),<br>1.7 g of gelatine and<br>0.5 g of coupler M2 emulsified with 0.5 g of tricresylphosphate |
| Layer 7 | (2nd green-sensitized layer)<br>green-sensitized silver iodobromide emulsion prepared from 1.5 g of $AgNO_3$ (mixture of 70% by weight of an emulsion containing 7 mol-% of iodide and having an average particle diameter of 0.8 m and having a narrow particle size distribution and 30% by weight of an emulsion containing 10 mol-% of iodide and having an average particle diameter of 0.8 μm and a broad particle size distribution),<br>1.7 g of gelatine and<br>0.2 g of coupler M2 emulsified with 0.2 g of tricresylphosphate |
| Layer 8 | (Interlayer)<br>0.5 g of gelatine and<br>0.06 g of 2,5-diisooctylhydroquinone |
| Layer 9 | (yellow filter layer)<br>yellow colloidal silver sol containing<br>0.1 g of Ag,<br>0.35 g of gelatine and<br>0.2 g of compound WM-1 |
| Layer 10 | (1st blue-sensitive layer)<br>silver iodobromide emulsion prepared from 0.6 g of $AgNO_3$ (mixture of 90% by weight of an emulsion containing 5 mol-% of iodide and having an average particle diameter of 0.2 μm and 10% by weight of an emulsion containing 7 mol-% of iodide and having |

-continued

| | |
|---|---|
| | an average particle diameter of 0.8 μm), |
| | 1.4 g of gelatine and |
| | 0.85 g of coupler Y-2 emulsified with |
| | 0.85 g of tricresylphosphate |
| Layer 11 | (2nd blue-sensitive layer) |
| | silver iodobromide emulsion prepared from |
| | 1.0 g of $AgNO_3$ (mixture of 50% by weight |
| | of an emulsion containing 7 mol-% of iodide |
| | and having an average particle diameter |
| | of 0.8 μm and a narrow grain size distribution and |
| | 50% by weight of an emulsion containing |
| | 10 mol-% of iodide and having an average |
| | particle diameter of 0.8 μm and a broad |
| | grain size distribution), |
| | 0.6 g of gelatine and |
| | 0.3 g of coupler Y2 |
| | emulsified with 0.3 g of tricresylphosphate. |
| Layer 12 | (UV absorbent layer) |
| | 1.5 g of gelatine and |
| | 0.8 g of compound UV-1 |
| Material 4 | (according to the invention) |
| Layer 13 | (Interlayer) |
| | 0.9 g of gelatine |
| | 0.45 g of compound WM-1 |
| | 0.10 g of hydropropyl methyl cellulose hexahydrophthalate having an average particle diameter of 2.0 μm |
| Material 5 | (not according to the invention) |
| Layer 13 | (Interlayer) |
| | 0.9 g of gelatine and |
| | 0.45 g of compound WM-1 |
| Material 6 | (not according to the invention) |
| Layer 13 | (Interlayer) |
| | 0.9 g of gelatine |
| | 0.45 g of compound WM-1 |
| | 0.10 g of polymethyl methacrylate with an average particle diameter of 2.0 μm (insoluble in alkali) |

The layer arrangement described above (Layers 1 to 13) was hardened by being coated with the following layer:

| Layer 14 (hardening protective layer) | |
|---|---|
| 0.2 g | of gelatine, |
| 0.152 g | of polymethyl methacrylate, |
| 0.15 g | of hydroxypropyl methyl cellulose hexahydrophthalate, |
| 0.025 g | of compound VI-1, |
| 0.063 g | of dimethylpolysiloxane and |
| 0.7 g | of the hardener used in Layer 15 of Material 1 |

The results are summarized in Tables 1 to 3.

C2

5% by weight

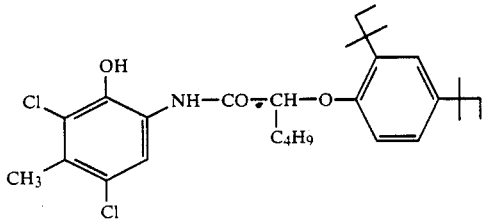

95% by weight

-continued

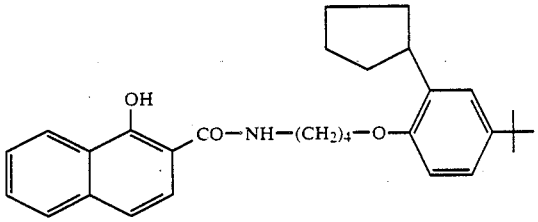

M2

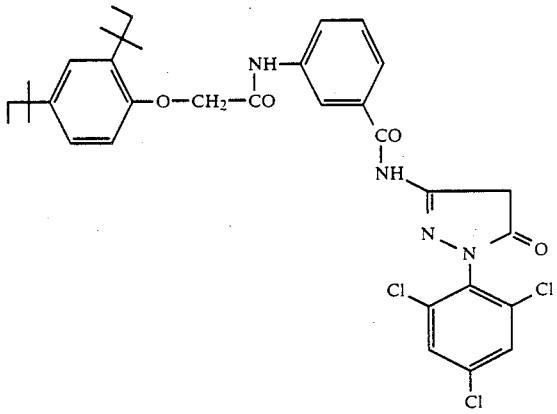

Y2

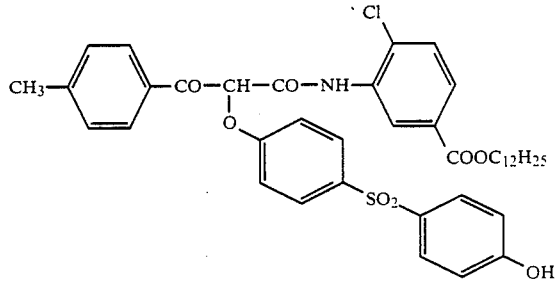

TABLE 1

| Material 1–6 (Partial layer arrangements) | | | | | |
|---|---|---|---|---|---|
| | Coefficient of friction | | | | |
| Material | back surface/ layer | plush/ layer | layer/ layer | Surface resistance 50% RH | Surface resistance 20% RH |
| 1 | 38 | 33 | 32 | $4.1 \cdot 10^{11}\Omega$ | $5.0 \cdot 10^{12}\Omega$ |
| 2 | 63 | 38 | 48 | $5.8 \cdot 10^{11}\Omega$ | $9.1 \cdot 10^{12}\Omega$ |
| 3 | 41 | 32 | 35 | $4.6 \cdot 10^{11}\Omega$ | $6.5 \cdot 10^{12}\Omega$ |
| 4 | 23 | 26 | 27 | | |
| 5 | 35 | 28 | 36 | | |
| 6 | 28 | 28 | 31 | | |

TABLE 2

| Materials 1–6 complete set of layers | | | |
|---|---|---|---|
| | | Parallel breaking strength | |
| Material | Disfigurement by patches | Breaking diameter [mm] | Breaking force [N] |
| 1 | 0% | 0.5 | 16 |
| 2 | 80% | 0.5 | 16 |
| 3 | 0% | 0.7 | 14 |
| 4 | 0% | 2.7 | 7 |
| 5 | 70–80% | 2.7 | 7 |
| 6 | 0% | 2.9 | 6 |

TABLE 3

| Sharpness | MTF | | | | Graininess RMS, aperture of 48 μm diameter | | |
|---|---|---|---|---|---|---|---|
| Material | 5 | 10 | 20 l/mm | *D = 0.5 | 1.0 | 1.5 | 2.0 |
| 1 | 1.02 | 0.93 | 0.73 | — | 10 | — | 20 |
| 2 | 1.02 | 0.93 | 0.73 | — | 10 | — | 20 |
| 3 | 0.98 | 0.87 | 0.65 | — | 12 | — | 22 |
| 4 | 1.19 | 1.15 | 1.07 | 5 | 6 | 7 | — |
| 5 | 1.18 | 1.16 | 1.07 | 5 | 6 | 7 | — |
| 6 | 1.08 | 1.12 | 1.02 | 8 | 9 | 11 | — |

*D = densities above fog and mask

We claim:

1. A silver halide color photographic element comprising a support, on the support at least one red-sensitive silver halide emulsion layer containing at least one non-diffusible cyan coupler, at least one green-sensitive silver halide emulsion layer containing at least one non-diffusible magenta coupler, at least one blue-sensitive silver halide emulsion layer containing at least one yellow coupler and at least one interlayer which is not the layer of the photographic element furthermost from the support said interlayer containing polymer particles soluble in alkali in a quantity of from 20 to 200 mg/m$^2$ of the photographic element and having an average particle diameter of from 0.5 to 3.0 μm.

2. A silver halide color photographic element of claim 1 wherein the polymer particles consist of cellulose derivatives of semi-esters of dicarboxylic acids.

3. A silver halide photographic element of claim 1 wherein the polymer particles are soluble in water at a pH above 7.

4. A silver halide color photographic element according to claim 1 wherein the polymer particles are used in a quantity of from 50 to 120 mg/m$^2$ of photographic material.

5. A silver halide color photographic element according to claim 1 wherein the polymer particles consist of hydroxy propylmethyl cellulose hexahydrophthalate.

* * * * *